US008096640B2

(12) United States Patent
Blair et al.

(10) Patent No.: US 8,096,640 B2
(45) Date of Patent: Jan. 17, 2012

(54) PRINT BAR

(75) Inventors: Dustin W Blair, Escondido, CA (US); Winthrop Childers, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 276 days.

(21) Appl. No.: 12/472,700

(22) Filed: May 27, 2009

(65) Prior Publication Data

US 2010/0302311 A1 Dec. 2, 2010

(51) Int. Cl.
*B41J 2/16* (2006.01)

(52) U.S. Cl. ..... 347/49; 347/42

(58) Field of Classification Search ..... 347/42, 347/47, 49, 13
See application file for complete search history.

(56) References Cited

U.S. PATENT DOCUMENTS 6,890,061 B1 5/2005 Freire et al.
7,287,831 B2 10/2007 Silverbrook

*Primary Examiner* — Lamson Nguyen
(74) *Attorney, Agent, or Firm* — Steven R. Ormiston

(57) ABSTRACT

In one embodiment, a print bar includes: a substrate having a longer part and a shorter part extending along and parallel to the longer part such that each end of the longer part extends past each end of the shorter part; and multiple printhead dies on the longer part of the substrate. In another embodiment, a modular print bar includes a first module including multiple printhead dies joined together end to end and a second module including multiple printhead dies joined together end to end. The second module is lapped together end to end with the first module.

15 Claims, 9 Drawing Sheets

PRINT BAR

BACKGROUND

In some inkjet printers a media wide array of stationary printheads is used to print on media moving past the array. For wider media, greater than 12" for example, individual printhead modules each holding several printhead dies are usually arranged in a staggered configuration in which adjacent modules are offset from one another in the direction the media moves past the printheads. Also, the individual printhead dies within each module usually are also arranged in a staggered, offset configuration, thus creating a compound stagger—die to die and module to module. Offset array configurations make overall printer space less efficient and they present significant difficulties coordinating ink drop placement between printhead dies and between printhead modules to minimize print defects inherent in the staggered configuration.

DRAWINGS

DESCRIPTION

Embodiments of the new print bar were developed in an effort to shrink the print zone in the media transport direction with a readily scalable printhead array that allows high quality printing across media widths of up to several meters. Embodiments are described with reference to inkjet printing. The embodiments shown in the figures and described below, however, are non-limiting examples. Other embodiments are possible and nothing in the following description should be construed to limit the scope of the disclosure, which is defined in the claims that follow this Description.

Although embodiments of the new print bar are not necessarily limited to dispensing ink or other liquids, and may be used for dispensing other fluids, inkjet printheads generally are not practical for dispensing fluids composed primarily of gas(es). Thus, "liquid" as used in this document means a fluid not composed primarily of a gas or gases. A "printhead" as used in this document refers to that part of an inkjet type drop dispensing structure or assembly that expels drops of liquid from one or more openings, typically an array of hundreds or thousands of tiny orifices. A "printhead" is not limited to printing with ink but also includes inkjet type dispensing of other liquids and/or for uses other than printing. "Media transport direction" means a direction parallel to the axis along which the print media would move past the printhead modules in a print bar if the print bar were installed in a printer. "Transverse direction" means a direction across the media transport direction. A transverse direction is not necessarily perpendicular to the media transport direction.

Figure 1:
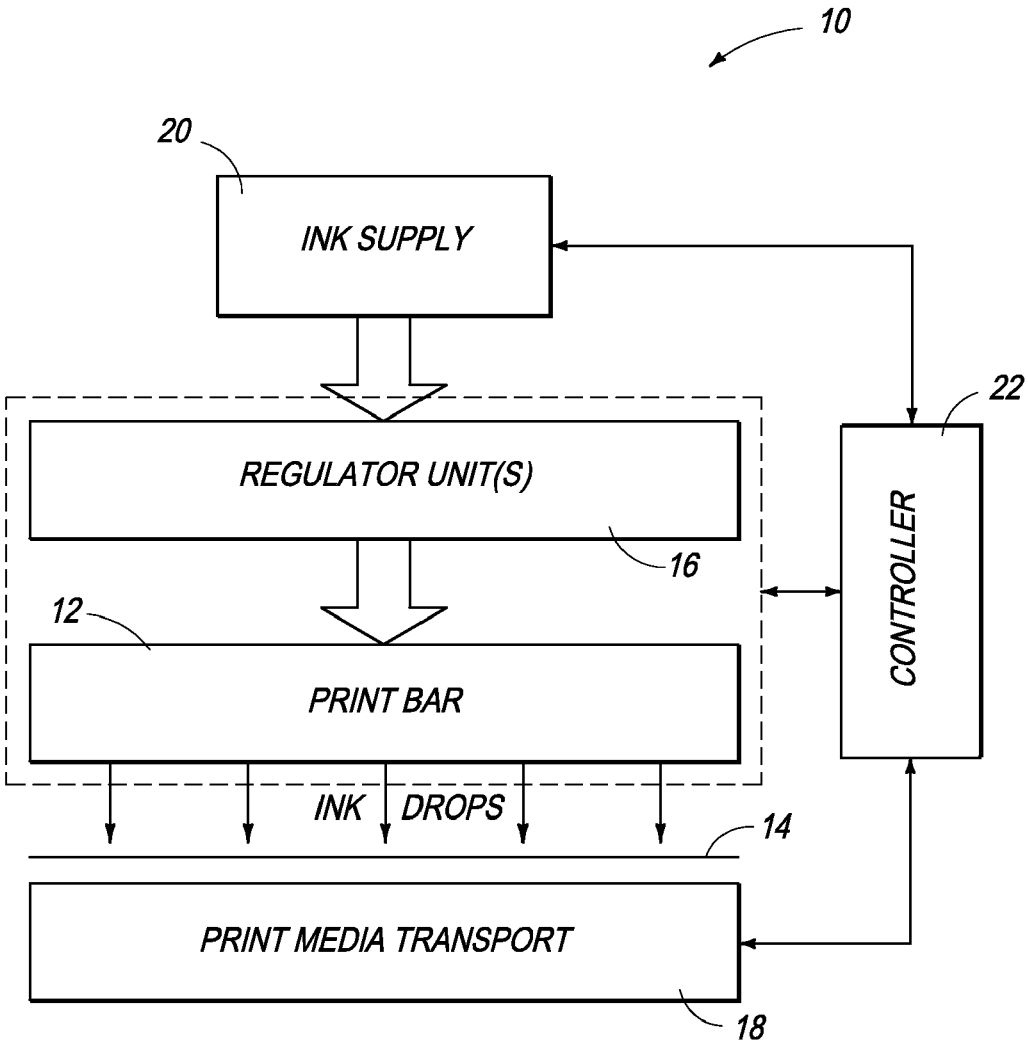
FIG. 1 is a block diagram illustrating one embodiment of an inkjet printer.

FIG. 1 is a block diagram illustrating an inkjet printer 10 that includes a print bar 12 spanning the width of a print media 14. Printer 10 also includes regulator units 16 associated with print bar 12, a media transport mechanism 18, an ink supply 20, and an electronic printer controller 22. Print bar 12 in FIG. 1 represents generally an array of modules each carrying one or more printhead dies and the associated mechanical and electrical components for ejecting drops of ink on to a sheet or continuous web of paper or other print media 14. A typical thermal inkjet printhead die, for example, includes an orifice plate arrayed with ink ejection orifices and firing resistors formed on an integrated circuit chip positioned behind the ink ejection orifices. The printhead die(s) in each module are electrically connected to printer controller 22, typically through a flexible circuit tape holding multiple electrical conductors (often called signal traces), and fluidically connected to ink supply 20 through regulator units 16. In operation, printer controller 22 selectively energizes ink ejector elements in a printhead die, or group of printhead dies, in the appropriate sequence to eject ink on to media 14 in a pattern corresponding to the desired printed image. Controller 22 in FIG. 1 represents generally the programming, processor(s) and associated memories, and the electronic circuitry and components needed to control the operative elements of a printer 10.

Figure 2:
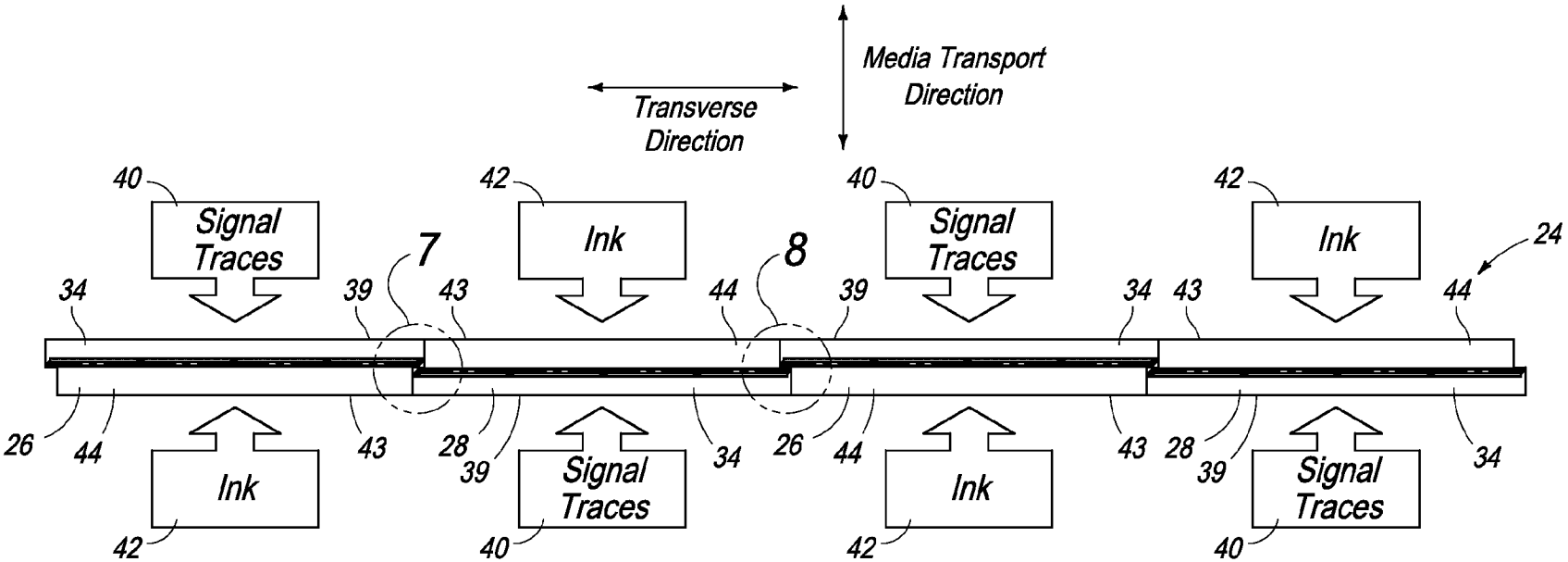
FIG. 2 is a bottom plan view illustrating a media wide modular print bar, such as might be used in the printer of FIG. 1, according to one embodiment of the disclosure.
Figure 3:
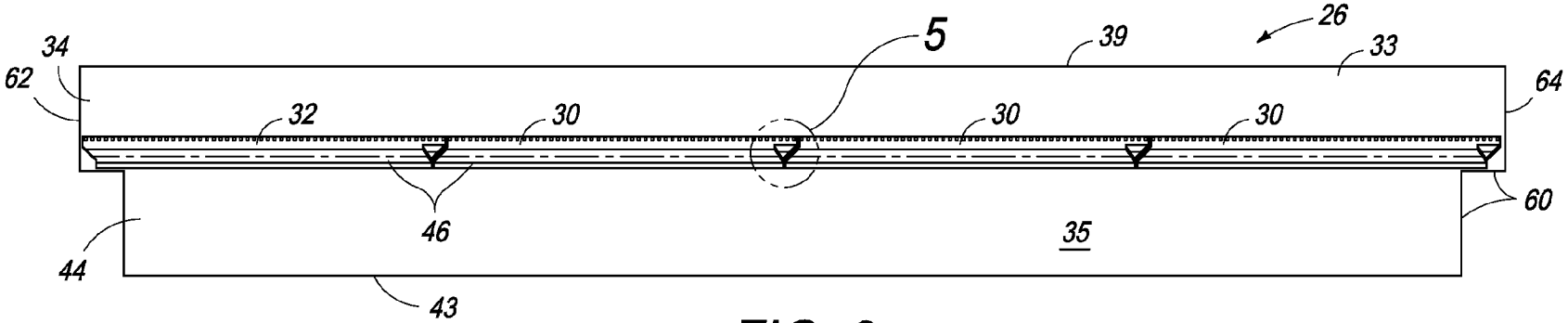
FIGS. 3 and 4 are more detailed bottom plan views of adjoining printhead modules from the print bar of FIG. 2.
Figure 4:
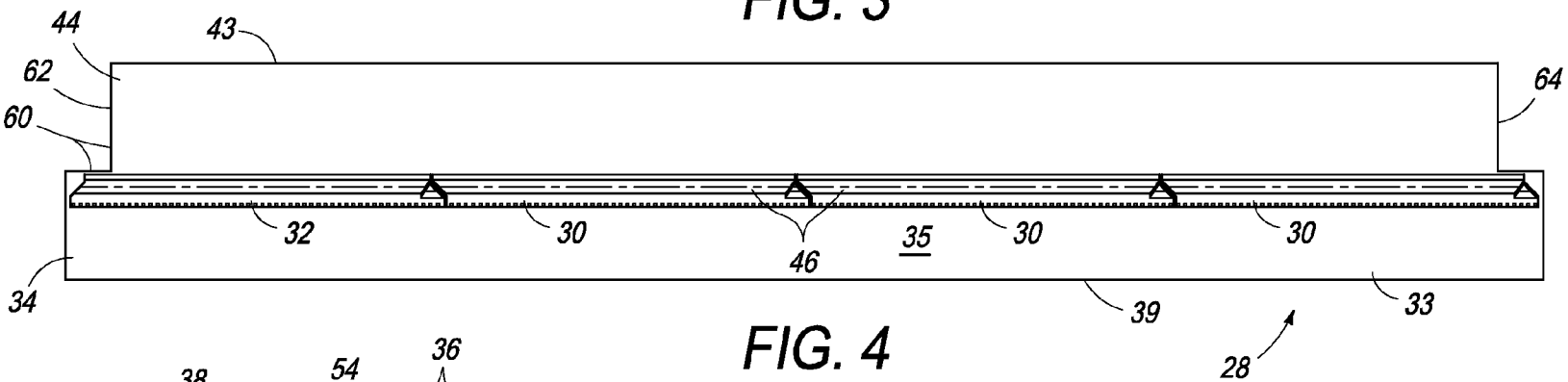

FIG. 2 is a bottom plan view illustrating one embodiment of a media wide modular print bar 24, such as might be used for print bar 12 in the printer of FIG. 1. FIGS. 3 and 4 are more detailed plan views of adjoining printhead modules 26 and 28 in print bar 24. Print bar 24 and modules 26, 28 in FIGS. 2-4 are viewed looking into the exposed ink ejection orifices, typically the bottom of the print bar 24 when the print bar 24 is installed in a printer.

Referring to FIGS. 2-4, print bar 24 includes multiple individual printhead modules 26 and 28 joined end to end with one another. Each printhead module 26, 28 includes multiple individual printhead dies 30 and 32 joined end to end with one another on a substrate 33. Printhead dies 30 and 32 are located on a longer part 34 of substrate 33 along the bottom 35 of each module 26, 28. Electrical contacts 36 are located along the outboard side 38 (FIGS. 5 and 6) of each die 30, 32 for connection to external circuits. Thus, power and other electrical conductors are routed to printhead dies 30, 32 over a longer edge 39 of substrate longer part 34 at the bottom 35 of each module 26, 28, resulting in an alternating configuration of the flex circuits or other suitable cabling feature 40 (FIG. 2) carrying power and other signal traces to modules 26 and 28. As described in more detail below with reference to FIGS. 13-16, ink is routed to printhead dies 30, 32 through flow control, pressure regulator units or other suitable ink supply features 42 (FIG. 2) over a shorter edge 43 of a substrate shorter part 44 along the top 45 (FIGS. 13-16) of each module 26, 28, resulting in an alternating configuration of ink supply units 42. This alternating configuration allows cabling 40 to be routed straight into each module 26, 28 to help minimize the length and thus the electrical resistance of the signal traces. Where, as here, cabling 40 is routed over longer edges 39, then the ink supply should be routed over shorter edges 43 in a similar alternating configuration if the ink is to be brought in from the sides of modules 26, 28.

Figure 5:
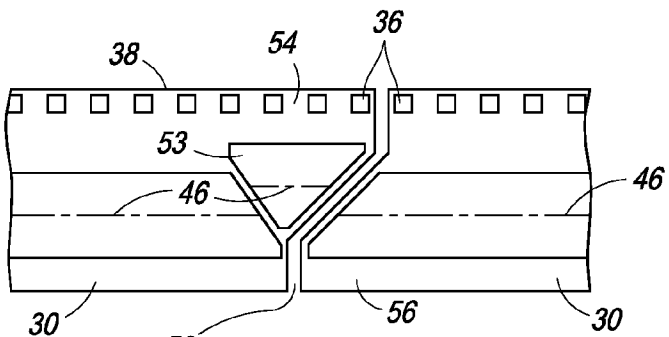
FIGS. 5 and 6 are more detailed views of one example embodiment of a joint between individual printhead dies in the module shown in FIG. 3.
Figure 6:
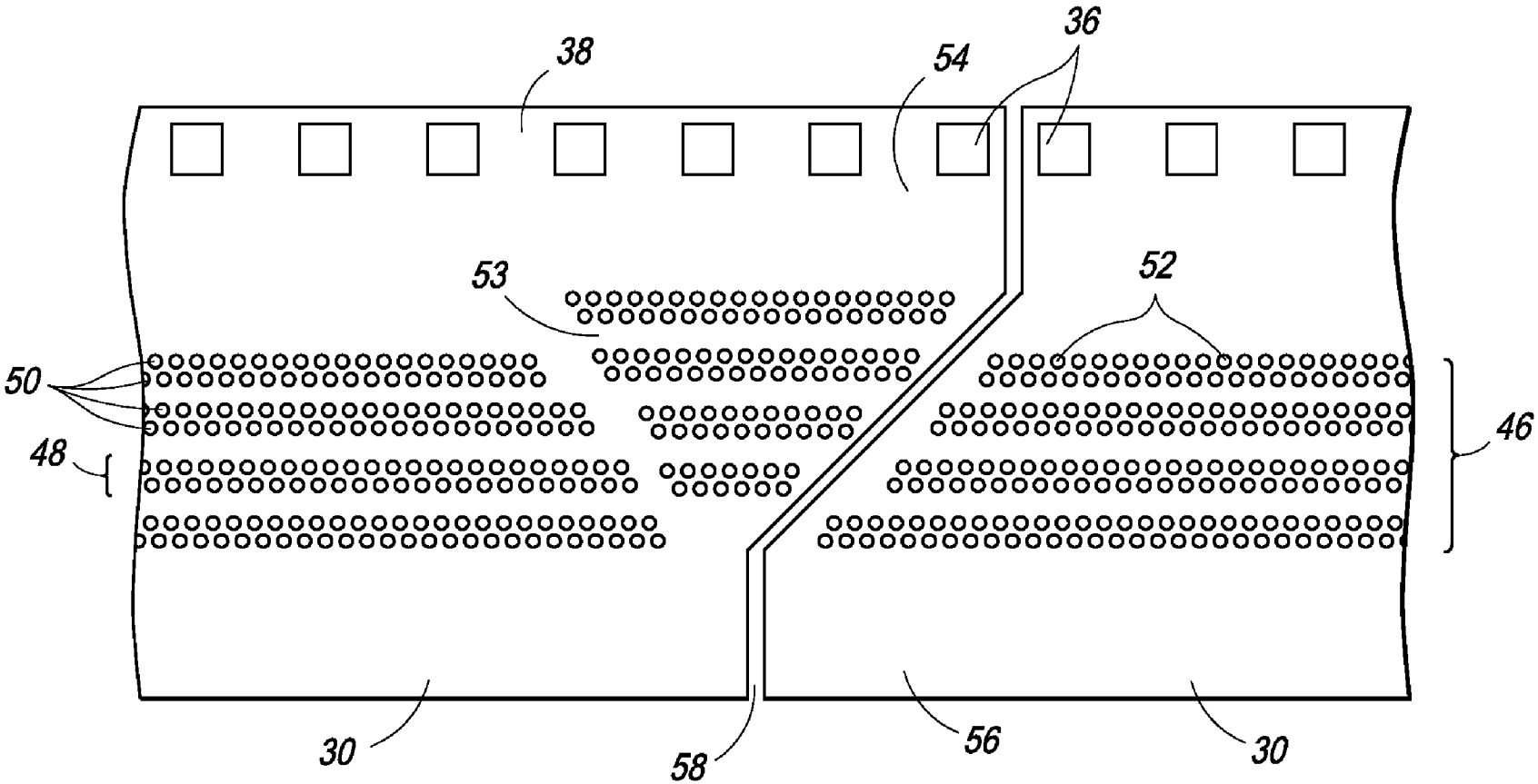

FIGS. 5 and 6 are detailed views of one example embodiment of the joints between individual printhead dies 30 in each module 26 and 28 shown in FIGS. 2-4. Due to the smaller scale of FIGS. 2-5, the array of ejector orifices is indicated generally by a centerline 46. The details of one example embodiment for an orifice array 46 are shown in the larger scale of FIG. 6 in which array 46 consists of four pairs 48 of rows 50 of orifices 52—the orifices 52 in each pair of rows 50 may be used to eject a different color ink, cyan, magenta, yellow and black (CMYK) for example. Referring to FIGS. 5 and 6, orifice array 46 is offset in a triangular configuration 53 at one end 54 of each printhead die 30, 32 and both ends 54 and 56 of each die 30, 32 are sloped along triangular offset 53 such that orifice array 46 (and orifices 52) overlap at the joint 58 between dies 30 and 32. Although a triangular offset configuration is shown, other suitable overlapping arrangements may be used. While this overlap arrangement makes it easier to minimize print defects at the joint between dies, this arrangement is not easily scaled up for use in media wide printing for wider print media. A single printhead die is currently limited to about 1" in width due to structural and processing limitations of the silicon die material. In addition, the number of dies that can be mounted together in a single printhead module is limited by the capacity of the mounting substrate to hold the dies in a flat plane. As the width of the printhead module exceeds about 8" (with 1" individual printhead dies, for example), a "potato chip" effect is observed in which the printhead dies are no longer held uniformly in a flat plane. Thus, a new modular print bar has been developed to shrink the print zone in the media transport direction with a readily scalable printhead array for printing across wider print media.

Figure 7:
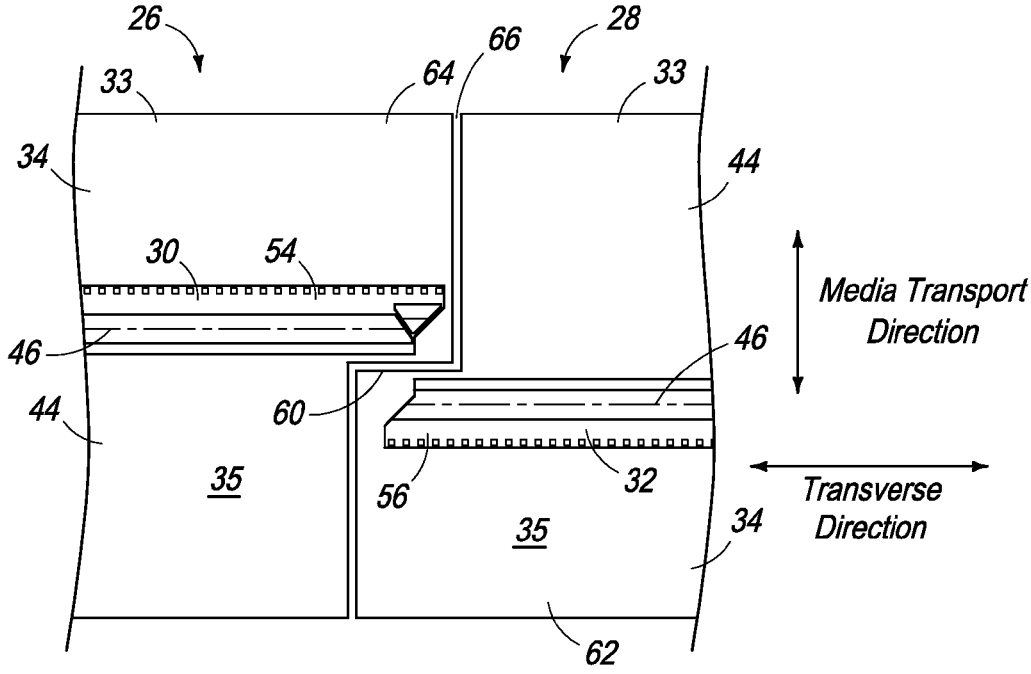
FIGS. 7 and 8 are more detailed views of one example embodiment of the joints between individual printhead modules in the print bar of FIG. 2.
Figure 8:
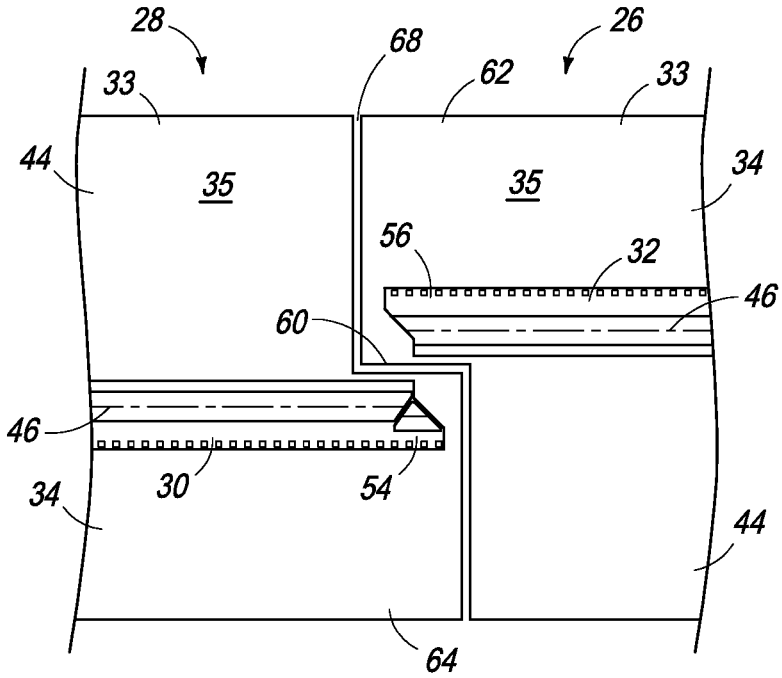

FIGS. 7 and 8 are more detailed views of one example embodiment of the joints between individual printhead modules 26 and 28 in print bar 24 (FIG. 2). Referring to FIGS. 7 and 8, the step 60 formed by the offset between longer and shorter parts 34 and 44 at the ends 62, 64 of each module 26, 28 fit together to form overlapping joints 66 (FIG. 7) and 68 (FIG. 8). This type of joint is commonly referred to as a lap joint. Thus, modules 26 and 28 are lapped together end to end at joints 66 and 68. (Where, as here, the parts joined are in line with one another, the lap joint is sometimes referred to as a half lap or half lap splice.)

Figure 9:
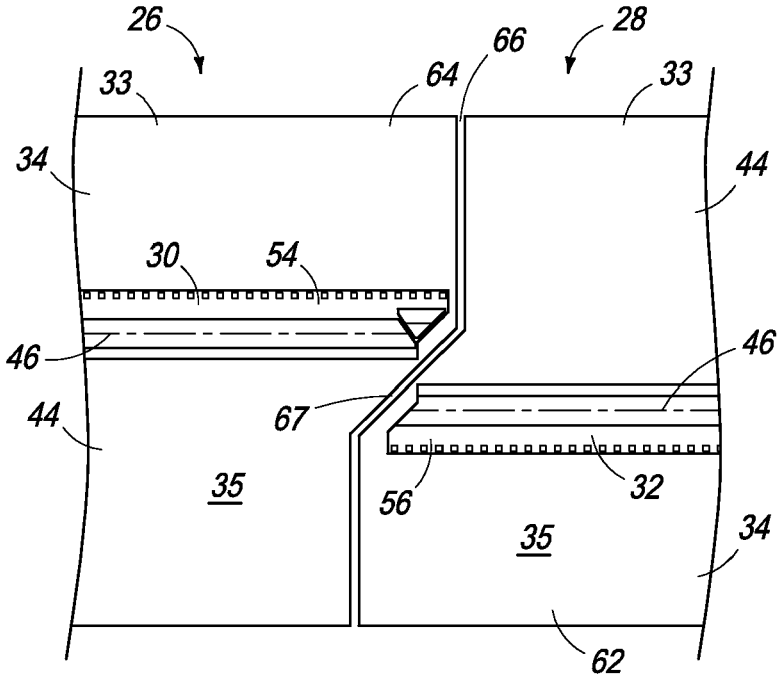
FIGS. 9 and 10 illustrate another example embodiment of the joints between individual printhead modules in a modular print bar.
Figure 10:
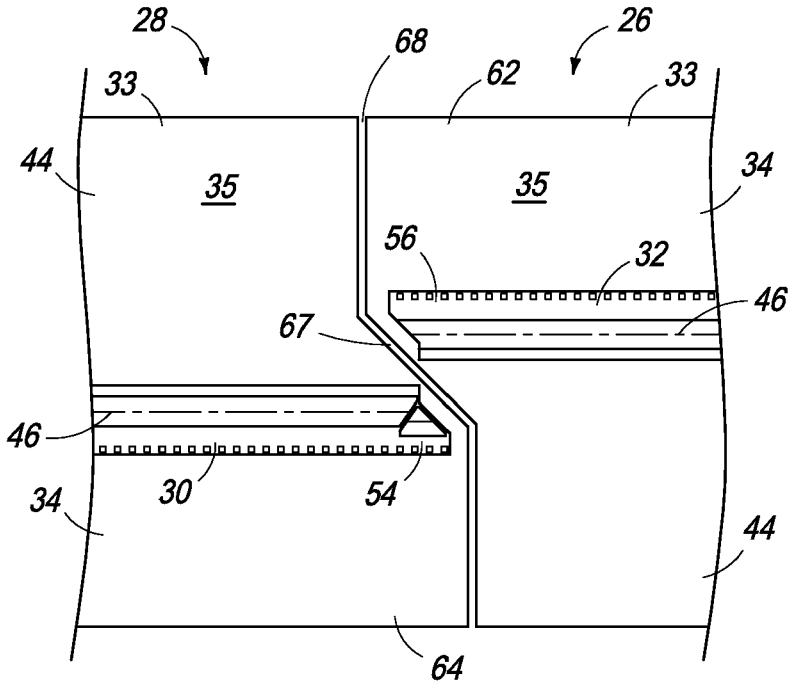

Referring now to FIG. 7, printhead dies 30 in modules 26 are oriented such that an offset die end 54 is adjacent to module right end 64 at joint 66. Printhead dies 32 in modules 28 are oriented such that a non-offset die end 56 matching offset die end 54 in module 26 is adjacent to module left end 62 at joint 66. Conversely, and referring to FIG. 8, printhead dies 32 in modules 26 are oriented such that a non-offset die end 56 is adjacent to module left end 62 at joint 68 and printhead dies 30 in modules 28 are oriented such that an offset die end 54 is adjacent to module right end 64 64 at joint 68. In an alternative configuration shown in FIGS. 9 and 10, modules 26 and 28 are lapped together at joints 66 and 68 through a sloped transition 67 between longer part 34 and shorter part 44. Thus, the orifice arrays 46 (and, therefore, orifices 52) in printhead modules 26 and 28 overlap at each lap joint 66 and 68. In these configurations, orifice arrays 46 in modules 26 and 28 are minimally offset from one another in the media transport direction but otherwise form a substantially seamless orifice array 46 in the transverse direction from module to module to module, etc.

The use of a lap joint allows overlapping orifice arrays 46 at joints 66 and 68 without staggering printhead modules 26 and 28, thus combining the benefits associated with overlapping orifices (ease in minimizing print defects along the joints) with the benefits of a linear array of printhead modules (space efficient and scalable). To accommodate lap joints 66 and 68, the line of printhead dies 30, 32 in adjoining modules 26 and 28 is offset in the media transport direction. That is to say, the line of printhead dies in adjoining modules is staggered in the media transport direction. This offset/stagger, however, is on the order of the width of a printhead die which is much smaller than the stagger/offset in conventional media wide array of printhead modules.

Figure 11:
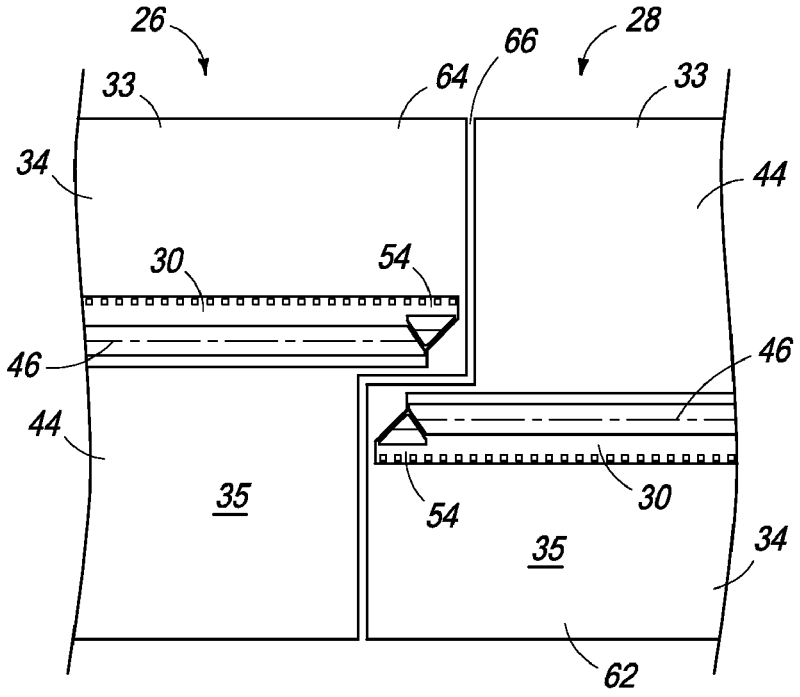
FIGS. 11 and 12 illustrate another example embodiment of the joints between individual printhead modules in a modular print bar.
Figure 12:
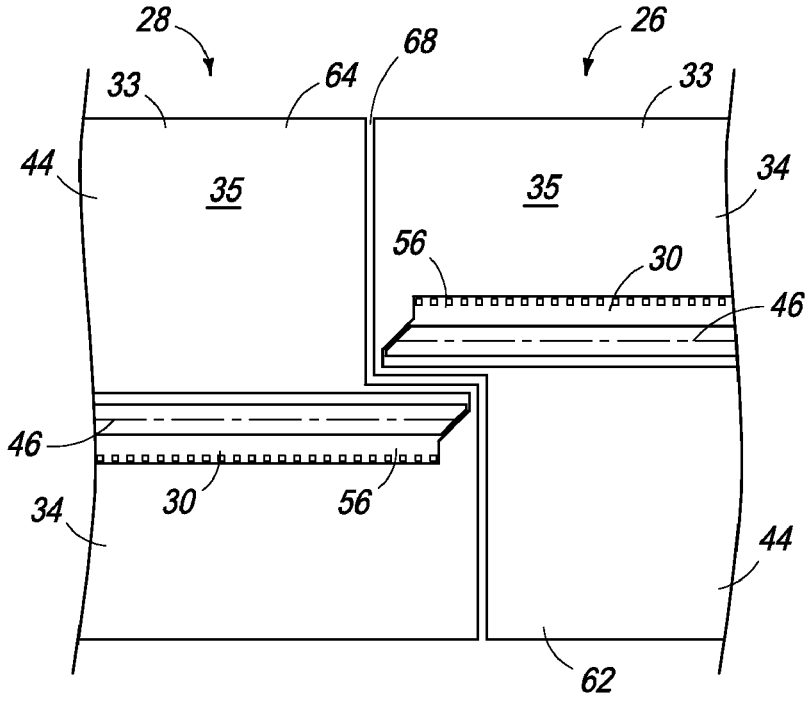

FIGS. 11 and 12 illustrate another example embodiment of joints 66 and 68. Referring to FIG. 11, printhead dies 30 are oriented such that an offset die end 54 is adjacent to the right end 64 in modules 26 and to the left end 62 of modules 28 at joint 66. Referring to FIG. 12, printhead dies 30 are oriented such that a non-offset die end 56 is adjacent to the left end 62 of modules 26 and to the right end 64 of modules 28 at joint 68. The configuration of dies 30 at joints 66 and 68 in FIGS. 11 and 12 may be advantageous in some implementations because it allows for identical printhead dies 30 on each printhead module 26 and 28. That is to say, the end printhead dies are the same as the other printhead dies on each module 26, 28 in the die configuration shown in FIGS. 11 and 12. In the die configuration of FIGS. 7-10, by contrast, each end die 32 is different from the other dies 30.

Figure 13:
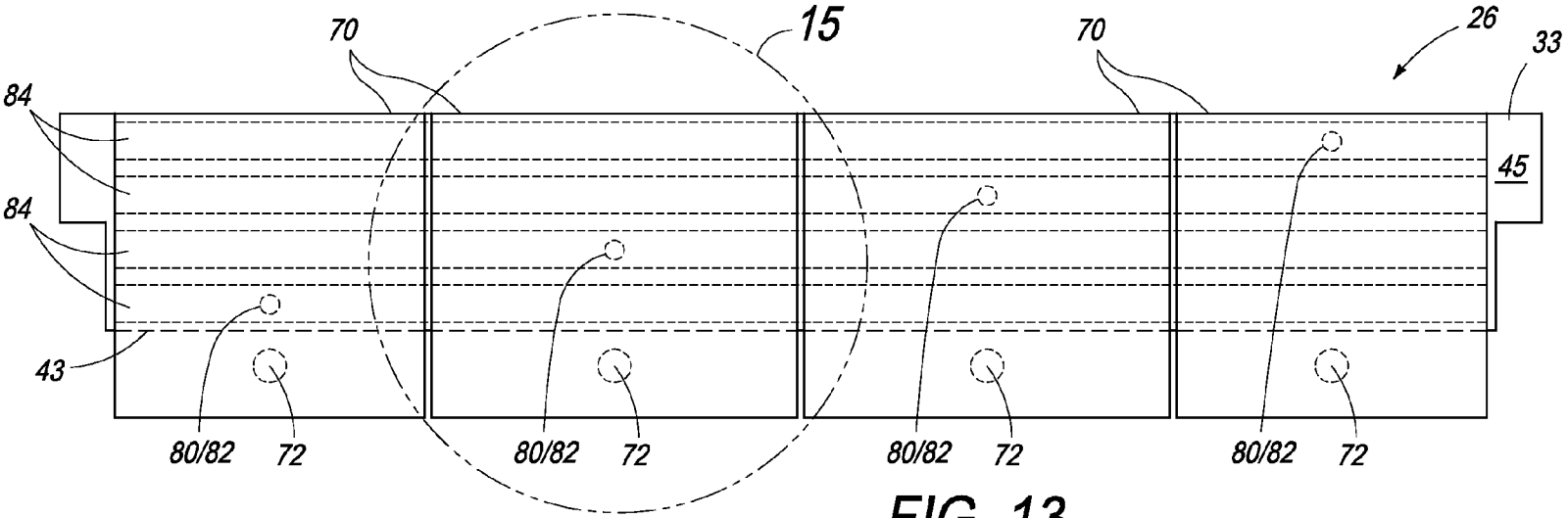
FIGS. 13 and 14 are top plan views of adjoining printhead modules illustrating one example embodiment for supplying ink to each module.
Figure 14:
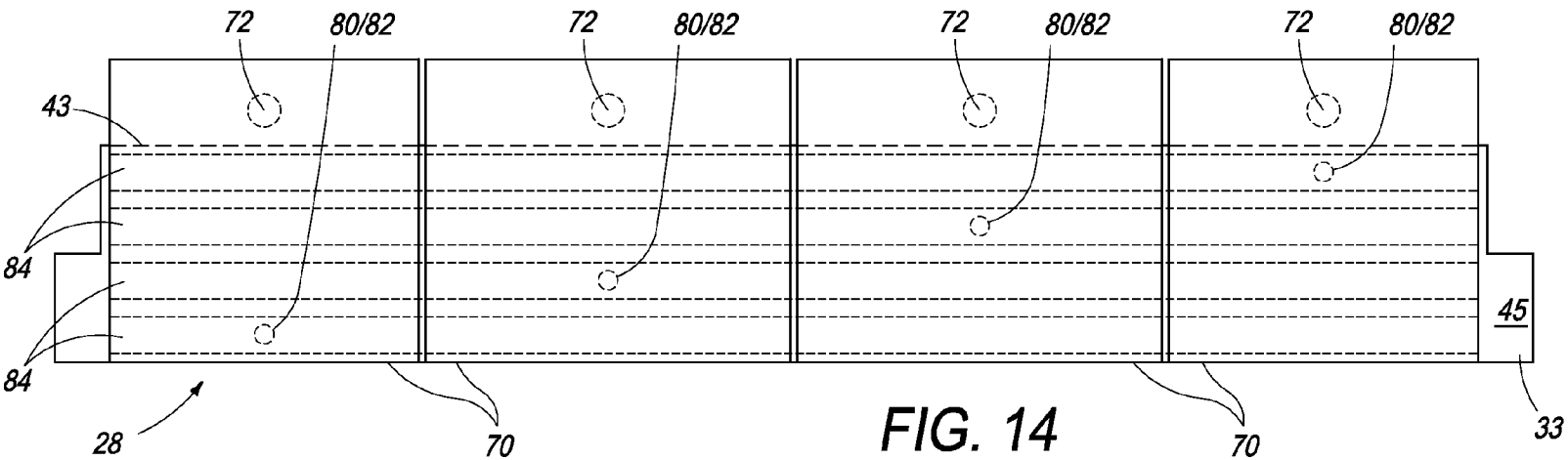
Figure 16:
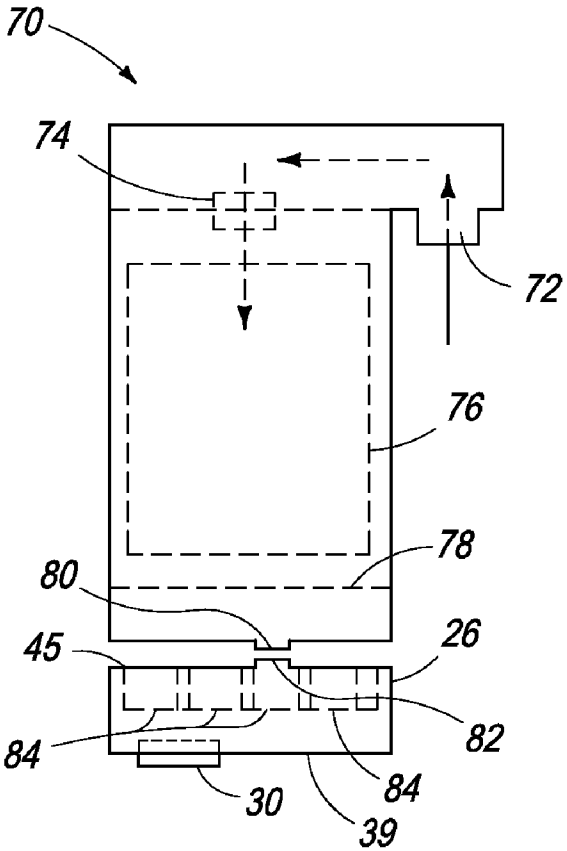
FIG. 16 is a side elevation view illustrating one example embodiment of a pressure regulator unit for supplying ink to a printhead module.
Figure 15:
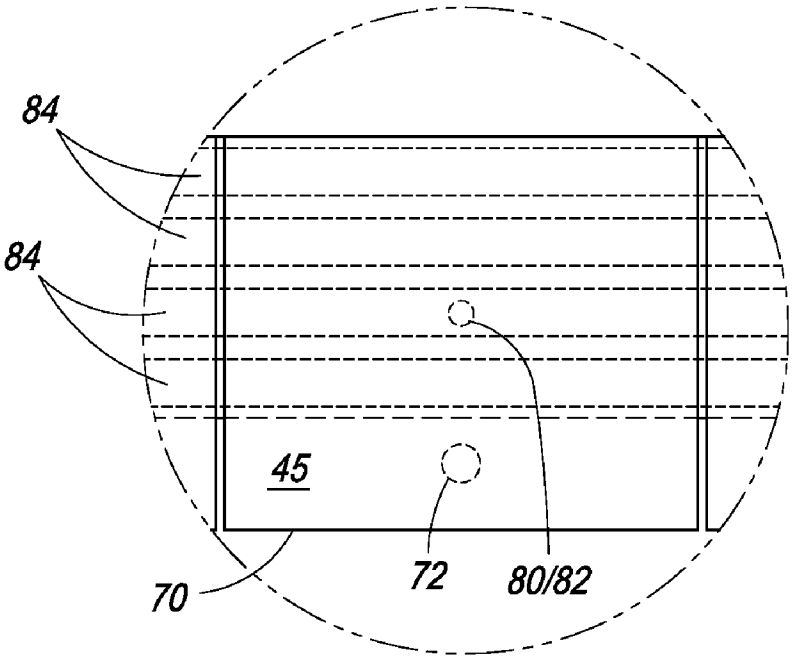
FIG. 15 is a detailed view of a portion of the printhead module shown in FIG. 13.

FIGS. 13 and 14 are plan views of adjoining printhead modules 26 (FIG. 13) and 28 (FIG. 14) illustrating one example embodiment for supplying ink to modules 26 and 28 and distributing ink to each printhead die 30, 32. FIG. 15 is a detailed view of a portion of printhead module 26 shown in FIG. 13. FIG. 16 is a side elevation view illustrating one example embodiment of a regulator unit 70, such as might be used for regulator units 16 in FIG. 1. Referring to FIGS. 13-16, in the example embodiment shown, four regulator units 70 are operatively coupled to each printhead module 26, 28. Each regulator unit 70 may be used to supply a different color ink, cyan, magenta, yellow and black (CMYK) for example. Referring specifically to FIG. 16, ink is pumped or otherwise delivered to each regulator unit 70 at an inlet 72, from a remote ink supply 20 (FIG. 1) for example. Each regulator unit 70 represents generally any suitable combination of elements for controlling the flow and regulating the pressure of ink supplied to printhead modules 26 and 28. In a typical regulator unit 70, for example, ink flows from inlet 72 through a flow control valve 74, pressure regulator 76, and filter 78 to an outlet 80, and from outlet 80 to an inlet 82 to printhead module 26. The components of regulator unit 70 may include conventional flow control, pressure regulator and filter components well known to those skilled in the art of inkjet printing. Although a separate pressure regulator unit 70 is shown for each of four different color inks, other configurations are possible. For example, a single, dual-chambered regulator unit 70 may be used to supply two different color inks to two module inlets 82.

Referring again to FIGS. 13-16, ink is distributed from module inlets 82 to printhead dies 30, 32 in each module 26, 28 through a series of conduits 84 that span the length of dies 30, 32. Using the example noted above, each conduit 84 carries a different color ink from the corresponding pressure regulator unit 70 to printhead dies 30 and 32. Other configurations are possible. For example, more than four conduits will be used if additional inks or other fluids are desired.

Openings (not shown) along the bottom of each conduit 84 allow ink to flow into the slots in each printhead die 30, 32 that feed the expulsion chambers (not shown) for individual orifices 52 (FIG. 6). For the orifice array 46 shown in FIG. 6, each conduit 84 would supply a different color ink to each pair 48 of rows 50 of orifices 52 (through the corresponding feed slots and firing chambers in printhead dies 30, 32). In the embodiment shown in FIGS. 13-16, ink is routed to each inlet 72 over the shorter edge 43 of module shorter part 44. This configuration facilitates the adaptation of a conventional pressure regulator unit for use as unit 70 and helps provide clearance for ink supply lines (not shown) into inlets 72.

The present disclosure has been shown and described with reference to the foregoing exemplary embodiments. It is to be understood, however, that other forms, details and embodiments may be made without departing from the spirit and scope of the disclosure which is defined in the following claims.

What is claimed is:

1. A print bar, comprising:

a substrate having a longer part and a shorter part extending along and parallel to the longer part such that each end of the longer part extends past each end of the shorter part; and multiple printhead dies on the longer part of the substrate.

2. The print bar of claim 1, wherein the multiple printhead dies are arranged on the substrate such that an array of orifices on each printhead die extends parallel to a long axis of the substrate.

3. The print bar of claim 2, wherein:

the substrate comprises multiple substrates each having a longer part of the substrate and a shorter part extending along and parallel to the longer part such that each end of the longer part extends past each end of the shorter part, the substrates arranged end to end in a linear configuration in which one end of the longer part of one substrate adjoins one end of the shorter part of an adjoining substrate;

each substrate has multiple printhead dies arranged on the substrate such that an array of orifices on each printhead die extends parallel to the long axis of the substrate;

shorter edges along the shorter parts of the substrates are substantially aligned with and parallel to one another; and longer edges along the longer parts of the substrates are substantially aligned with and parallel to one another.

4. A modular print bar, comprising:

a first module including multiple printhead dies joined together end to end; and a second module including multiple printhead dies joined together end to end, the second module lapped together in line end to end with the first module.

5. The print bar of claim 4, wherein an orifice array in a first printhead die in the second module is offset from an orifice array in a last printhead die in the first module in a media transport direction but otherwise forms a substantially seamless continuation of the orifice array in a transverse direction.

6. The print bar of claim 4, wherein an orifice array in a first printhead die in the second module is offset from an orifice array in a last printhead die in the first module in a media transport direction and overlaps the orifice array in the last printhead die in the first module in a transverse direction.

7. The print bar of claim 4, wherein:

each of the first and second modules is characterized by a longer part and a shorter part extending along and parallel to the longer part such that each end of the longer part extends past each end of the shorter part; and the printhead dies in each of the first and second modules extend lengthwise along the longer part of the module.

8. The print bar of claim 7, wherein each printhead die includes multiple electrical contacts thereon extending along a side of the printhead die opposite the shorter part of the module.

9. A modular print bar assembly, comprising:

multiple modules each having a longer edge along a longer part of the module and a shorter edge along a shorter part module, the longer part of each module extending along and parallel to the shorter part of each module such that each end of the longer part extends past each end of the shorter part;

multiple printhead dies on the longer part of each module;

an array of orifices across each printhead die through which liquid may be dispensed from the printhead die;

multiple electrical contacts on each printhead die extending across the printhead die between the orifice array and the longer edge of the module;

multiple conduits across each module for carrying liquid to the printhead dies; and an inlet to each conduit through which liquid may introduced into the conduit.

10. The assembly of claim 9, wherein:

the shorter edges of the modules are substantially aligned with one another; and the longer edges of the modules are substantially aligned with one another.

11. The assembly of claim 10, wherein the printhead dies are arranged on each module such that the orifice array on each printhead die extends parallel to a long axis of the module.

12. The assembly of claim 11, wherein the orifice array in a first printhead die on each module is offset from the orifice array in a last printhead die on an adjoining module in a media transport direction but otherwise forms a substantially seamless continuation of the orifice array in a transverse direction.

13. The assembly of claim 11, wherein an orifice array in a first printhead die on each module is offset from an orifice array in a last printhead die on an adjoining module in a media transport direction and overlaps the orifice array in the last printhead die in the adjoining module in a transverse direction.

14. The assembly of claim 11, further comprising multiple groups of electrical conductors, each group of conductors routed over the longer edge of a corresponding one of the modules and the conductors in each group connected to the electrical contacts on the printhead dies on the corresponding module.

15. The assembly of claim 14, further comprising multiple regulator units each located along a corresponding module and operatively connected to one or more of the inlets for controlling the flow and regulating the pressure of liquid supplied to the module, each regulator unit having a supply port overhanging the shorter edge of the corresponding module.

* * * * *